United States Patent [19]

Ammann

[11] 4,071,994

[45] Feb. 7, 1978

[54] EXPANSION JOINT FOR ROOFS AND THE LIKE

[76] Inventor: Ernst Ammann, Baltenswilerstr. 127, CH-Wallenwil, Switzerland, CH-8360

[21] Appl. No.: 704,099

[22] Filed: July 9, 1976

[30] Foreign Application Priority Data

July 10, 1975 Switzerland ..... 9057/75

[51] Int. Cl.[2] ..... E04B 1/62; E04B 1/68

[52] U.S. Cl. ..... 52/573; 52/403; 52/472

[58] Field of Search ..... 52/573, 743, 747, 94, 52/403, 396, 468, 395, 58, 472

[56] References Cited

U.S. PATENT DOCUMENTS

| | | | |
|---|---|---|---|
| 3,300,913 | 1/1967 | Patry et al. | 52/94 X |
| 3,369,831 | 2/1968 | McKinnie | 52/573 X |
| 3,375,621 | 4/1968 | Curtis et al. | 52/403 X |
| 3,581,450 | 6/1971 | Patry | 52/573 X |
| 3,694,976 | 10/1972 | Warshaw | 52/573 X |
| 3,713,263 | 1/1973 | Mullen | 52/573 X |
| 3,760,546 | 9/1973 | Martin et al. | 52/94 X |

*Primary Examiner*—Price C. Faw, Jr.
*Assistant Examiner*—Robert C. Farber
*Attorney, Agent, or Firm*—Karl F. Ross

[57] ABSTRACT

An expansion joint for roofs and the like, especially for the sheet-metal flashing or cover plates of the finial, cresting or ridge of flat roofs, comprises a pair of metal strips defining an expansion gap between them. The gap is bridged on the underside of the joint with an elastomeric sealing band bonded, e.g., by vulcanization, to the metal strips and covered, on its side turned toward the environment with an intermediate metal strip slidingly held in place by the elastomeric band so as not to impede relative displacements of the first two metal strips upon thermal expansion and contraction.

8 Claims, 7 Drawing Figures

FIG.6
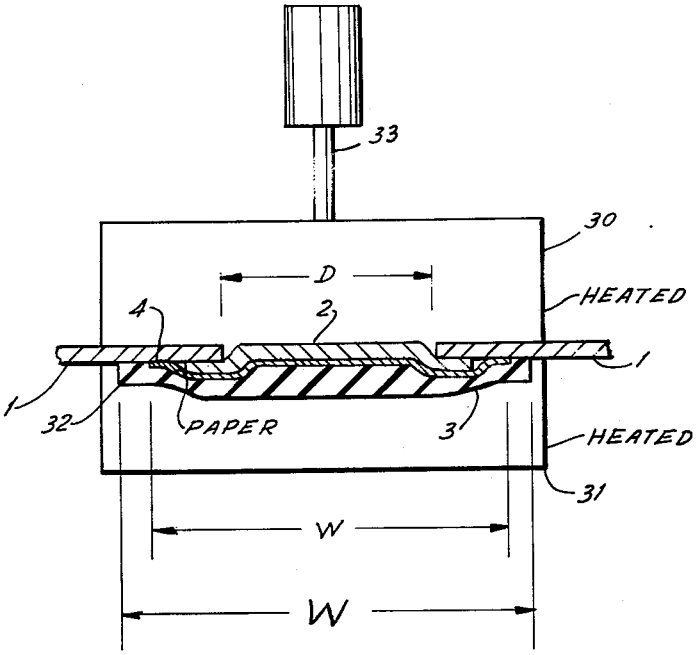
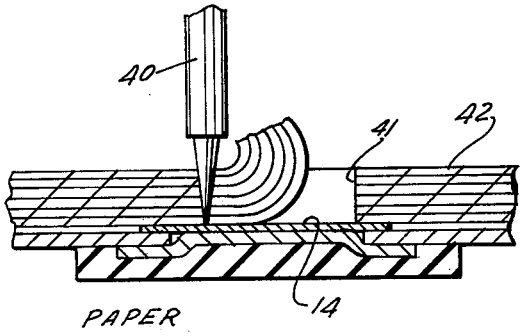
FIG.7

EXPANSION JOINT FOR ROOFS AND THE LIKE

FIELD OF THE INVENTION

The present invention relates to an expansion joint, especially for so-called flat roofs and particularly for the sheet-metal flashing or cover sheets normally used along the edges of such roofs to engage over the finial, cresting or ridge bordering same.

BACKGROUND OF THE INVENTION

In flat roofs of residential, commercial and industrial establishments it is not uncommon to provide a finial, cresting or ridge along the edge which must be sealed against the incursion of water by a flashing. The flashing, which generally engages over the finial, cresting or ridge, is frequently composed of sheet metal such as galvanized iron, copper or aluminum. The sheet metal usually extends beneath the roof covering which is applied along the flat portions of the roof bordering the ridge and may consist of a thick layer of tar, multiple layers of roofing paper or felt, one or more layers of asphalt covered with gravel (gravel roofs), the sealing being effected with roofing cement, molten tar or other bituminous products.

The sheet-metal rim of the roof has expansion characteristics which differ from those of the rest of the building and thus expansion joints are required in the sheet metal rim.

An earlier expansion joint system which can be used for such purposes is described in U.S. Pat. No. 3,123,188 as an expansion joint for metal panels and comprises a pair of profiled edges spanned by an elastomeric strip which seals the gap between the panels. With expansion joints of this type, it has been found that leakage occurs with the passage of time. Investigations have shown that the leakage is a result, in part, of the deterioration of the elastomeric band by exposure to the weather or, more generally, to ambient environment effects. The elastomeric material, generally composed of rubber or a rubber-like synthetic resin material, has an ultraviolet-light sensitivity which causes deterioration with time and frequently also has minimum resistance to chemical contaminants present in air.

The elastomeric material is further characterized by a low resistance to heat and is embrittled when hot tar or hot bitumen is used as the sealing material on the sheet-metal panels. Sprayers capable of depositing liquid sealing materials upon the panels also tend to damage the elastomeric band. There are of course known various heat-resistant materials which, however, have considerable sensitivity to ultraviolet light.

OBJECTS OF THE INVENTION

It is the principal object of the present invention to provide an improved seal between a pair of metal panels in which the aforementioned disadvantages are obviated and a long lasting sealing against the weather and incursion of moisture can be ensured.

Yet another object of the invention is to provide an improved structure without the disadvantages of the earlier systems mentioned above.

SUMMARY OF THE INVENTION

These objects and others which will become apparent hereinafter are attained in accordance with the present invention by providing an expansion joint which comprises a pair of sheet-metal strips having spaced-apart confronting edges which define an expansion gap between them, the gap being bridged by a band of elastomeric material which is sealingly bonded to the metal strip all along the longitudinal edges and is preferably vulcanized to the strips. A third or intermediate metal strip is held against the first mentioned or outer metal strips by the elastomeric band and covers the latter along the side of the expansion joint exposed to the environment.

The outer metal strips can be secured to the flashing or roofing sheet-metal sheets by conventional means, e.g., soldering or welding.

Preferably the expansion joint is used by conforming it in length and shape to the requirements of the particular roof and providing means for preventing the incursion of the sealing of the roof-sealing mass into the expansion gap during the application of this mass to the roof.

When the roof is to be covered with roofing paper or felt cemented in layers, it has been found to be advantageous to cover the cap temporarily with a layer which, after application of the roofing material, is fully or partly removed, e.g., cut or torn away, to create a gap between the portions of the roofing material in line with the expansion gap. The gap in the roofing material can be filled with a synthetic-resin or other sealing strip.

When the roof is covered with an asphalt layer, i.e., molten tar or bitumen, it has been found to be advantageous to dispose over the expansion gap a bead yieldable transversely to the longitudinal dimension of the gap and which is embedded in the asphalt when the latter is applied. The bead can remain in the roofing material and have a thickness corresponding to the thickness of the asphalt layer applied.

According to a feature of the invention, therefore, the expansion joint for the roof structure adapted to be exposed to the ambient environment comprises a pair of first sheet-metal strips having confronting longitudinal edges defining an expansion gap between them, the strips having outwardly turned faces on the side of the joint exposed to the environment and inwardly turned faces. An elastomeric sealing band spans this gap and is bonded by vulcanization continuously to both of the first strips along the inwardly turned faces thereof alongside these longitudinal edges, the band forming with these strips a water-tight seal. A second sheet-metal strip bridges the gap and is retained by the band against the first strips with freedom of sliding movement between the second strip and the first strips, the second strip overlapping the first strips along the longitudinal edges and covering the band along the environmentally exposed side of the joint, thereby shielding the band from the environment.

In one advantageous embodiment of the present invention, the cover sheet-metal strip overlies the first strips and is retained by the elastic pressure of the band against the inner surfaces of the latter. In another embodiment, the sealing band is vulcanized at spaced-apart locations to the cover strip which overlies the first sheet metal strips and is drawn against the latter by the elasticity of the elastomeric band.

The system described above can be part of a roof structure, in which case the expansion joint reaches over the ridge, finial or cresting and has a profile corresponding thereto. The roof assembly thus further comprises a covering layer for the flat portions or flanges of the expansion joint which may therefore reach over the roofing material, the latter being subdivided into two sections along the expansion gap. The space between these sections may be filled with the aforementioned bead.

Preferably the expansion joint is shaped concurrently with the vulcanizing of the sealing band to the several strips, i.e., the vulcanization press serves simultaneously to bond the elastomeric band to the underside of the outer metal strips and to conform the intermediate metal strip to the desired configuration.

BRIEF DESCRIPTION OF THE DRAWING

The above and other objects, features and advantages of the present invention will become more readily apparent from the following description, reference being made to the accompanying drawing in which:

FIG. 6 is a cross-sectional view, also in diagrammatic form, illustrating the fabrication of the expansion joint of FIG. 1; and FIG. 7 is a diagram illustrating another mode of using the expansion joint in a roof structure according to the present invention.

SPECIFIC DESCRIPTION

Figure 1:
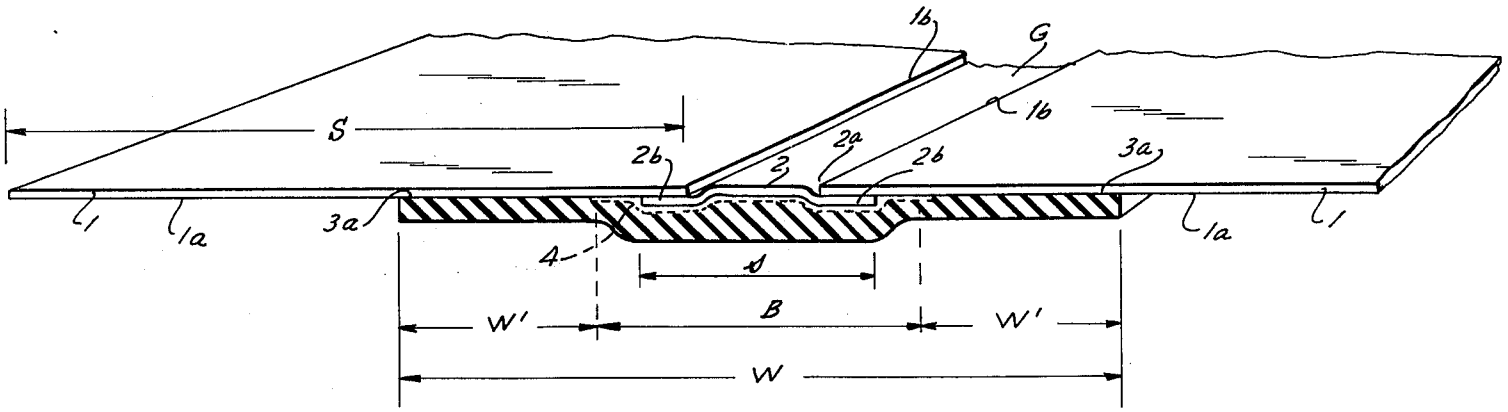
FIG. 1 is a perspective cross-sectional view through one embodiment of the expansion joint of the present invention in which the longitudinal edges of the intermediate strip underlie the outer strips.

In FIG. 1 I show an expansion joint which comprises a pair of lateral or outer sheet-metal strips 1 having a width S which is several times greater than the width *s* of an intermediate metal strip serving to cover the outer surface of an elastomeric band having a width W and bonded to the inner surfaces or undersides 1*a* of the strips 1 along the longitudinal edges 1*b* thereof. The band 3 is composed of an elastomer and is vulcanized at 3*a* to the surfaces 1*a* over regions of a width W', the central region B being unbonded to the strips 1. In the embodiment of FIG. 1, the expansion gap G between the edges 1*b* is bridged from below by the intermediate sheet-metal strip 2. This preferred embodiment of the invention has several advantages.

Firstly, the expansion joint can be fabricated simply from two different widths of sheet-metal strips without imparting any special profile to the strips before assembling of the joint. As can be seen from FIG. 6, the special configuration can be brought about simultaneously with vulcanization of the elastomeric material to the outer strips under heat and pressure.

To this end the vulcanization press comprises an upper die 30 which is movable by a hydraulic cylinder arrangement 33 toward a fixed lower die 31 formed with a concavity 32 in which the flat elastomeric strip 3 is laid. The sheet-metal strip 2 is placed centrally upon the vulcanizable rubber band 3 and the strips 1 are then laid on top of the edges of the strip 2. The press is thereupon closed. In the gap G, with a width D, the pressure is sufficient to cause the central portion 2*a* of the strip 2 to bend upwardly and become coplanar with the strips 1. The outer edges of the strip 2, however, remain as flanges 2*b* overlying the strips 1.

To prevent bonding of the vulcanizable strip 3 to the intermediate strip 2, a paper layer 4 of a width B is provided between the elastomer and the sheet-metal strips. As a result, the width W' over which the band 3 is bonded to each of the strips 1 is half of the difference W − B.

Since the band 3 is not bonded to the intermediate strip 2 over a region of the width B, the expansion and contraction can take place over substantially the entire region thereof.

To permit conforming of the expansion joint to the configuration of the ridge, finial or cresting of the roof it is advantageous to allow the intermediate strip 2 to have longitudinal mobility along the gap G. Then, if the expansion joint is bent at a right angle transversely to the gap G the relative mobility enables a bending radius of the outer lateral strips 1 greater than that of the inner intermediate strip 2 by an amount equal to the thickness of the strips. Creasing of the strips is avoided.

Figure 2:
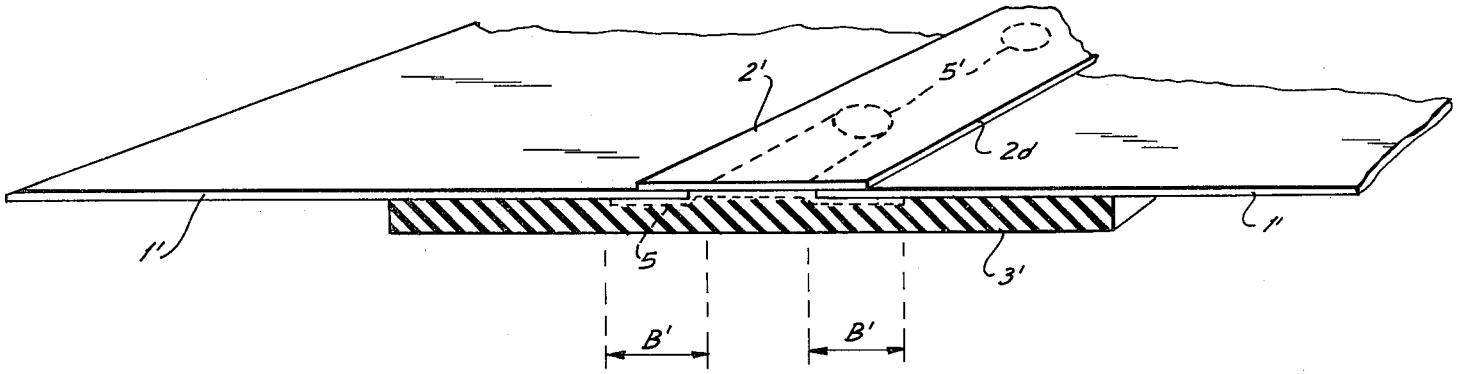
FIG. 2 is a view similar to FIG. 1 of an embodiment in which the longitudinal edges of the intermediate strip overlie the outer strips.

A similarly functioning arrangement is found in FIG. 2 with a kinematic reversal. In this embodiment, however, the strip 2' overlies the strips 1' and is held by vulcanization at spaced-apart locations 5 by the elastomeric band 3 against the strips 1. The strips 1' are, of course, vulcanized to the band 3' in the region of contact permitted by paper strip 5 which is formed with holes to permit vulcanization at spots 5'. The region of relative mobility of strips 1' and 2' is represented at B'.

FIGS. 3 through 5 and 7 show the use of the expansion joint of the present invention.

Figure 3:
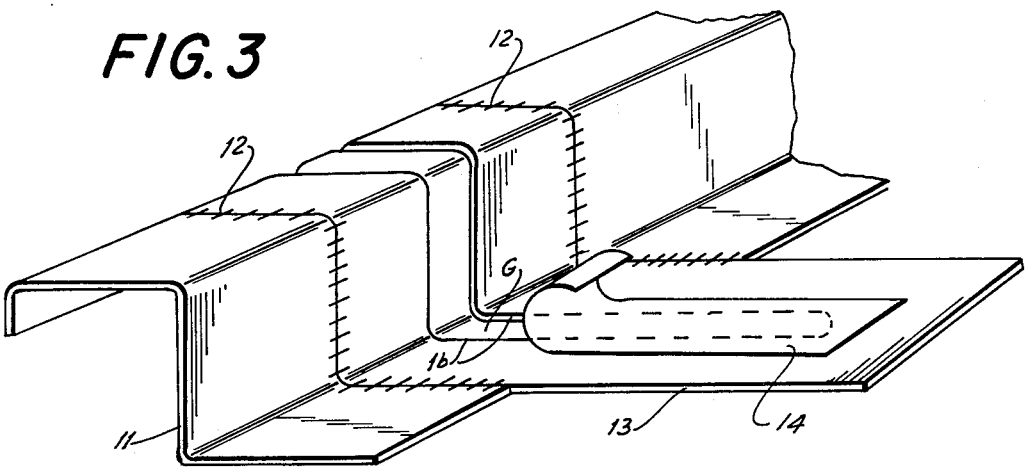
FIG. 3 is a perspective view, somewhat diagrammatic form, showing how the expansion joint is assembled with the flashing sheets of the roof structure.

In FIG. 3, the expansion joint is shown to be connected by solder or welded seams 12 to the sheet-metal flashing or panels 11 extending over the ridge, finial or cresting of the roof. Once the expansion band is fixed in place, the covering of the roof can be carried out.

When roofing paper or felt is to be applied, the gap C can be covered over its entire length by an adhesive tape 14 which can be wider than the gap G and prevents the penetration of the sealing material into the gap between the outer strips 1 and this intermediate strip 2.

In a gravel roofing system, a first layer of roofing felt is cut so that it directly adjoins the edge 13 of the joint or only slightly overlaps the latter and is held in place with liquid tar or bitumen. The next layer is applied so that ot overlaps both layers and the process is repeated until a multiplicity of layers is built up as shown at 42 in FIG. 7. According to the invention, the laminate of roofing coating and felt papers is thereupon cut through, by a knife 40, along the gap edge 1*b* (in the case of the embodiment of FIG. 1) or along the outer edge 2*d* (in the case of the embodiment of FIG. 2), whereupon the strip 14 is removed along the cut region to clear a gap 40 between the portions of the roofing coating 42 underlying the expansion gap. The newly formed gap 41 can be filled with a bead such as has been illustrated at 23 in FIG. 4.

Figure 4:
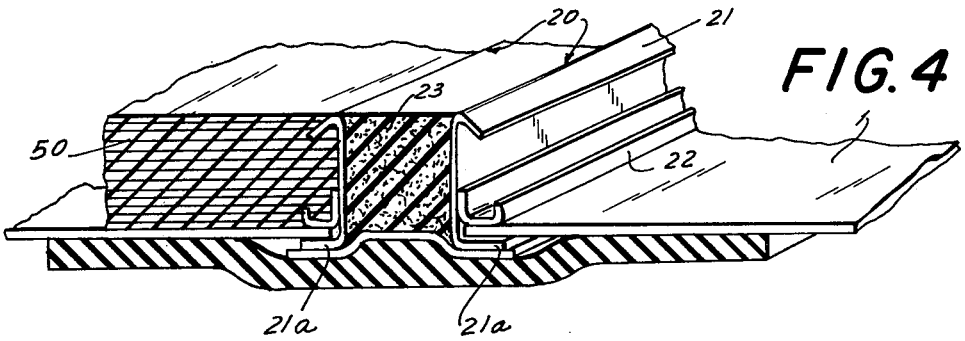
FIG. 4 is a perspective cross-sectional view of the roof assembly when hot tar or molten bitumen is used as the roofing composition.
Figure 5:
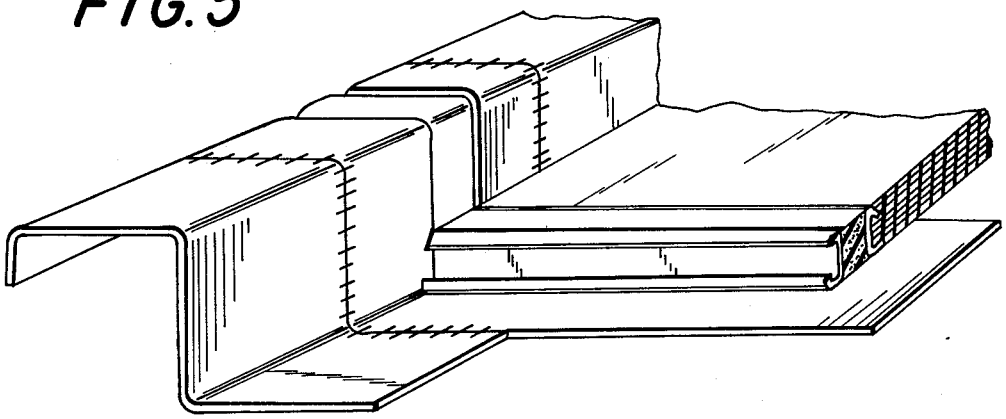
FIG. 5 is a plan perspective view of the expansion joint thus formed.

For an asphalt roof, as is shown in FIGS. 4 and 5, in place of the adhesive tape of FIG. 3, the gap G is covered by a bead consisting of profile bars 21, whose outwardly extending flanges 21*a* are forced under the strips 1 above the flanges 2*b*, the profiles 21 having channels 22 which overlie the strips 1. A foam-rubber closed-pore strip 23 is forced into the gap 20 between the profiles 21 and is preferably adhesively bonded thereto.

The tar layer 50 can then be filled onto the roof to a thickness equal to the height of the structure 21, 22.

I claim:

1. An expansion joint for structures adapted to be exposed to the ambient environment, comprising:

a pair of first sheet-metal strips having confronting longitudinal edges defining a gap between them, said strips having outwardly turned faces on a side of the joint exposed to the environment and inwardly turned faces;

an elastomeric sealing band spanning said gap bonded continuously to both of said strips along the inwardly turned faces thereof and alongside said longitudinal edges, said band forming with said first strips a water-tight seal; and a second sheet-metal strip bridging said gap and retained by said band against said first strips with freedom of sliding movement between said second strip and said first strips along said longitudinal edges and covering said band along said side of said joint, thereby shielding said band from the environment, said sealing band being vulcanized to said first strips along regions spaced from but parallel to said longitudinal edges, said second strip overlapping each of said first strips along said longitudinal edges.

2. The use of the expansion joint defined in claim 1 in fabricating a roof structure which comprises covering said gap to prevent the incursion of roofing materials therein.

3. A roof structure comprising the expansion joint defined in claim 1 secured to a pair of roofing plates and covered with a roofing material, said structure further comprising a bead received in said material and extending said gap, said bead being yieldable transversely of said gap.

4. An expansion joint for structures adapted to be exposed to the ambient environment, comprising:

a pair of first sheet-metal strips having confronting longitudinal edges defining a gap between them, said strips having outwardly turned faces on a side of the joint exposed to the environment and inwardly turned faces;

an elastomeric sealing band spanning said gap bonded continuously to both of said strips along the inwardly turned faces thereof and alongside said longitudinal edges, said band forming with said first strips a water-tight seal; and a second sheet-metal strip bridging said gap and retained by said band against said first strips with freedom of sliding movement between said second strip and said first strips along said longitudinal edges and covering said band along said side of said joint, thereby shielding said band from the environment, said sealing band being vulcanized to said first strips along regions spaced from but parallel to said longitudinal edges, said second strip being held by said band against the inwardly turned faces of said first strips.

5. The expansion joint defined in claim 4, further comprising sheet material interposed between said band and said second strip for preventing bonding of said band to said second strip.

6. An expansion joint for structures adapted to be exposed to the ambient environment, comprising:

a pair of first sheet-metal strips having confronting longitudinal edges defining a gap between them, said strips having outwardly turned faces on a side of the joint exposed to the environment and inwardly turned faces;

an elastomeric sealing band spanning said gap bonded continuously to both of said strips along the inwardly turned faces thereof and alongside said longitudinal edges, said band forming with said first strips a water-tight seal; and a second sheet-metal strip bridging said gap and retained by said band against said first strips with freedom of sliding movement between said second strip and said first strips along said longitudinal edges and covering said band along said side of said joint, thereby shielding said band from the environment, said sealing band being vulcanized to said first strips along regions spaced from but parallel to said longitudinal edges, said second stip being held by said band against said outwardly turned faces of said first strips.

7. The expansion joint defined in claim 6, further comprising sheet material interposed between said band and said second strip for preventing bonding of said band to said second strip.

8. An expansion joint for structures adapted to be exposed to the ambient environment, comprising:

a pair of first sheet-metal strips having confronting longitudinal edges defining a gap between them, said strips having outwardly turned faces on a side of the joint exposed to the environment and inwardly turned faces;

an elastomeric sealing band spanning said gap bonded continuously to both of said strips along the inwardly turned faces thereof and alongside said longitudinal edges, said band forming with said first strips a water-tight seal; and a second sheet-metal strip bridging said gap and retained by said band against said first strips with freedom of sliding movement between said second strip and said first strips along said longitudinal edges and covering said band along said side of said joint, thereby shielding said band from the environment, said sealing band being vulcanized to said first strips along regions spaced from but parallel to said longitudinal edges said band being vulcanized to said second strip.

* * * * *